US008933381B2

(12) United States Patent
Kanzaki et al.

(10) Patent No.: US 8,933,381 B2
(45) Date of Patent: Jan. 13, 2015

(54) PACKAGING POUCH FOR MICROWAVE OVEN

(75) Inventors: Keizou Kanzaki, Yokohama (JP); Taketo Sakurai, Yokohama (JP); Shie Nishimoto, Yokohama (JP)

(73) Assignee: Toyo Seikan Kaisha, Ltd., Chiyoda-ku, Tokyo (JP)

( * ) Notice: Subject to any disclaimer, the term of this patent is extended or adjusted under 35 U.S.C. 154(b) by 1557 days.

(21) Appl. No.: 11/912,490

(22) PCT Filed: Apr. 28, 2006

(86) PCT No.: PCT/JP2006/308944

§ 371 (c)(1),
(2), (4) Date: Jul. 16, 2009

(87) PCT Pub. No.: WO2006/120933

PCT Pub. Date: Nov. 16, 2006

(65) Prior Publication Data

US 2009/0314773 A1 Dec. 24, 2009

(30) Foreign Application Priority Data

May 2, 2005 (JP) ..... 2005-134381

(51) Int. Cl.

| | |
|---|---|
| ***H05B 6/80*** | (2006.01) |
| ***B65D 81/34*** | (2006.01) |
| ***B65D 33/01*** | (2006.01) |
| ***B65D 33/00*** | (2006.01) |
| ***B65D 65/26*** | (2006.01) |
| ***B65D 77/22*** | (2006.01) |

(52) U.S. Cl.

CPC ..... *B65D 81/3461* (2013.01); *B65D 77/225* (2013.01); *B65D 2205/00* (2013.01)

USPC ..... 219/735; 219/725; 219/733; 426/113; 383/100; 383/103; 383/200; 383/210

(58) Field of Classification Search

USPC ..... 383/44, 100, 200, 210, 103; 426/113; 219/121.67, 725, 733, 735

See application file for complete search history.

(56) References Cited

U.S. PATENT DOCUMENTS 4,890,744 A * 1/1990 Lane et al. ..... 222/107
2005/0255200 A1* 11/2005 Takahagi et al. ..... 426/113

(Continued)

FOREIGN PATENT DOCUMENTS

FR 2761348 A1 10/1998
JP 04-38984 U 4/1992

(Continued)

OTHER PUBLICATIONS

Extended Supplementary European Search Report dated Sep. 14, 2009, issued in corresponding European Application No. 06745825.7, filed Apr. 28, 2006.

*Primary Examiner* — Tu B Hoang
*Assistant Examiner* — Michael Hoang
(74) *Attorney, Agent, or Firm* — Christensen O'Connor Johnson Kindness PLLC

(57) ABSTRACT

Provided is a packaging pouch for a microwave oven, provided with a steam releasing seal portion having a weakened portion, in which no clogging occurs in the steam releasing seal portion at the time of heat-cooking in a microwave oven, and any clogging occurred can be automatically eliminated. In the present invention, hermetic sealing is effected through heat sealing of a plastic film, and at least one steam releasing seal portion having a weakened portion is provided, with a width of the weakened portion gradually increasing from a forward end portion thereof to be opened toward a rear end portion thereof.

8 Claims, 9 Drawing Sheets

(56) References Cited

U.S. PATENT DOCUMENTS

| | | | | |
|---|---|---|---|---|
| 2005/0276885 | A1 | 12/2005 | Bennett | |
| 2006/0257056 | A1 * | 11/2006 | Miyake et al. | 383/103 |

FOREIGN PATENT DOCUMENTS

| | | | | | |
|---|---|---|---|---|---|
| JP | 10-059433 | A | | 3/1998 | |
| JP | 10-095470 | A | | 4/1998 | |
| JP | 10-095471 | A | | 4/1998 | |
| JP | 10-101154 | A | | 4/1998 | |
| JP | 2002-249176 | A | | 9/2002 | |
| JP | 2002249176 | A | * | 9/2002 | B65D 81/34 |
| JP | 2003-192042 | A | | 7/2003 | |
| JP | 2005-082172 | A | | 3/2005 | |
| JP | 2005082172 | A | * | 3/2005 | |
| WO | 03/051745 | A1 | | 6/2003 | |

* cited by examiner

PACKAGING POUCH FOR MICROWAVE OVEN

TECHNICAL FIELD

The present invention relates to a packaging pouch for a microwave oven filled with a content such as a retort food containing a liquid substance, a solid substance, or a mixture of them. The packaging pouch of the present invention is capable of automatically releasing steam or the like to be generated inside the packaging pouch, and preventing rupture and deformation of the packaging pouch and scattering of the content when heated in a microwave oven.

BACKGROUND ART

Heating of a hermetically sealed packaging pouch filled with a retort food, a frozen food, or the like in a microwave oven increases a pressure inside the pouch due to steam or the like generated from a content under heating. The packaging pouch may suffer rupture, and the content may scatter, so there is a fear that the inside of the microwave oven is made dirty, a human body is burned, or the like.

Thus, before heat-cooking such the packaging pouch in a microwave oven, methods of preventing the rupture of the packaging pouch is employed. That is, the packaging pouch is partly opened in advance or the packaging pouch itself is pierced, to thereby discharge steam or the like generated inside the packaging pouch.

However, such the method involves much time and effort for a general consumer. Further, this method has a disadvantage in that a taste is lost because the steam generated through microwave heating is immediately discharged out of the packaging pouch, and a heating steaming effect of the steam on the content reduces.

Further, to automatically release the increased inner pressure of the packaging pouch at the time of heating in the microwave oven, there have been proposed the following packaging pouches: (1) a packaging pouch in which a weakened seal portion is formed in a part of a peripheral edge heat seal portion of the packaging pouch by interposing a thin film and in which a narrow seal portion with a small heat seal width is provided in a part of the weakened seal portion (see Patent Document 1); (2) a packaging pouch in which a weak adhesive portion is provided in a part of the peripheral edge heat seal portion of the packaging pouch and in which there is formed a non-sealed portion reducing the width of the weak adhesive portion from an outer edge of the weak adhesive portion toward an interior (see Patent Document 2); a packaging pouch in which there are provided in a part of the peripheral edge seal portion of the packaging pouch a non-sealed portion with a locally reduced seal width and an inner swell seal portion corresponding thereto (see Patent Document 3); (4) a packaging pouch in which a heat-shrinkable film forming an opening at the time of heating is sandwiched in a part of an opening portion of the packaging pouch (see Patent Document 4); etc.

[Patent Document 1] JP 10-59433 A
[Patent Document 2] JP 10-95471 A
[Patent Document 3] JP 10-101154 A
[Patent Document 4] JP 10-95470 A However, these conventional packaging pouches require a complicated process for forming the opening portion, resulting in an increase in cost. Further, the seal strength of the opening portion of the packaging pouch is rather low, so the requisite seal strength (2.3 kg/15 mm-width or more) for a retort food packaging pouch cannot be obtained. Thus, a portion where opening is to be effected or the peripheral edge seal portion suffers rupture at the time of retorting, and there are limitations regarding the content with which the pouch is to be filled. Further, during the transportation or storage of the packaging pouch with the content sealed therein, the pouch will suffer rupture, making it impossible to maintain a sealing property.

The present inventors have already found out and proposed that these problems in the prior art can be eliminated by providing a steam releasing seal portion having a weakened portion, such as a through-hole, a semi-through-hole, or a slit, in a packaging pouch hermetically sealed by heat-sealing with a plastic film (see Patent Document 5).

Further, in such the packaging pouch provided with a steam releasing seal portion having a weakened portion, to prevent separation of an interface not contributing to the sealing of a steam releasing seal portion composed of a laminated film due to some impact during the process of forming a weakened portion, such as a through-hole, a semi-through-hole, or a slit, in the steam releasing seal portion, the present inventors have proposed a construction in which, as shown in FIG. 15, a steam releasing seal portion 6 is formed by an outer seal portion 3, a cushioning portion 4 adjacent to the outer seal portion 3, and a weakened portion 5 provided in the cushioning portion 4 (see Patent Document 6).

[Patent Document 5] JP 2002-249176 A
[Patent Document 6] JP 2003-192042 A

The packaging pouches as disclosed in Patent Documents 5 and 6 each of which is provided with a steam releasing seal portion having a weakened portion help to eliminate the problems in the prior art as disclosed in Patent Documents 1 through 4, making it possible to attain the desired object. It should be noted, however, that, when these packaging pouches are filled with solid objects of a small size, such as boiled rice, rice porridge, or curry roux, and hermetically sealed before being heat-cooked in a microwave oven, the pressure in the pouch increases due to the steam, etc. generated from the content as a result of the heating. When an opening is generated in the steam releasing seal portion through separation thereof, clogging may occur in the steam releasing seal portion by a small solid object such as a rice grain, thereby interfering with the automatic opening of the steam releasing seal portion.

DISCLOSURE OF THE INVENTION

Problems to be Solved by the Invention

Accordingly, it is an object of the present invention to provide a packaging pouch for a microwave oven provided with a steam releasing seal portion having a weakened portion, in which no clogging occurs in the steam releasing seal portion at the time of heat-cooking in a microwave oven, and in which any clogging occurred can be automatically eliminated. Further, it is an object of the present invention to provide a packaging pouch for a microwave oven in which the impact at the time of opening through heating in a microwave oven is suppressed and in which, if any clogging occurs, the opening is gradually enlarged to thereby make it possible to eliminate the clogging.

Means for Solving the Problems

An easily conceivable method of preventing clogging in a packaging pouch for a microwave oven at the time of heat-cooking, would be to provide a hole as a weakened portion formed in the steam releasing seal portion and to enlarge that hole. However, when the content of the packaging pouch is a flat and soft solid object, there is a high possibility of the hole being occupied over a wide range to thereby cause clogging. Further, it has become clear that when the hole is enlarged, the impact at the time of opening is rather strong, resulting in a loud sound giving discomfort to the user, breakage of the film starting from the opening, or the content being spilled out.

After careful study, the present inventors have found out that the above problems can be solved through appropriate contrivance in terms of the configuration of the weakened portion formed in the steam releasing seal portion, thus completing the present invention.

In other words, the present invention uses the following constructions as described in items 1 through 12.

1. A packaging pouch for a microwave oven, which is hermetically sealed by heat-sealing with a plastic film, characterized in that the packaging pouch comprises at least one steam releasing seal portion having a weakened portion, and the weakened portion includes a portion where a width of the weakened portion gradually increases from a forward end portion of the weakened portion to be opened toward a rear end portion.

2. A packaging pouch for a microwave oven according to item 1, characterized in that a constricted portion where the weakened portion is reduced in width is provided in at least one position in a range from the forward end portion of the weakened portion to be opened to the rear end portion of the weakened portion.

3. A packaging pouch for a microwave oven according to items 1 or 2, characterized in that a protrusion directed from the rear end portion of the weakened portion to be opened to an inner side of the weakened portion is provided, to thereby divide the weakened portion.

4. A packaging pouch for a microwave oven according to any one of items 1 through 3, characterized in that a non-sealed portion is provided in the steam releasing seal portion, and the weakened portion is formed in the non-sealed portion.

5. A packaging pouch for a microwave oven according to item 4, characterized in that the non-sealed portion is provided with a through-hole or a semi through-hole, to thereby form a weakened portion.

6. A packaging pouch for a microwave oven according to any one of items 1 through 5, characterized in that a steam releasing seal portion is provided separately from the peripheral edge seal portion of the packaging pouch.

7. A packaging pouch for a microwave oven according to any one of items 1 through 5, characterized in that the steam releasing seal portion is provided continuously along a peripheral edge seal portion of the packaging pouch.

8. A packaging pouch for a microwave oven according to any one of items 1 through 7, characterized in that an initial breakage point of the steam releasing seal portion is provided on a circumference or on an inner side of a circle inscribed in two shorter sides of a peripheral edge seal portion of the packaging pouch at centers of inner ends of the peripheral edge seal portion.

9. A packaging pouch for a microwave oven according to any one of items 1 through 8, characterized in that an outlet forming means is provided in the vicinity of the steam releasing seal portion.

10. A packaging pouch for a microwave oven according to any one of items 1 through 9, characterized in that the packaging pouch is one selected from the group consisting of a standing pouch, a flat pouch, and a branch type pouch.

11. A packaging pouch for a microwave oven according to any one of items 1 through 10, characterized in that the peripheral edge seal portion and an outer seal portion of the steam releasing seal portion has a seal strength of 2.3 kg/15 mm or more.

12. A packaging pouch for a microwave oven according to any one of items 1 through 11, characterized in that an opening facilitating processing through a laser processing is effected at a position of the packaging pouch where the pouch is to be opened.

Effect of the Invention

According to the present invention, it is possible to provide at low cost a packaging pouch for a microwave oven in which it is possible to prevent clogging in the steam releasing seal portion at the time of heat-cooking in a microwave oven and in which any clogging occurred can be automatically eliminated.

Further, according to the present invention, it is possible to provide a packaging pouch for a microwave oven in which the impact at the time of opening through heating in a microwave oven is suppressed and in which, if any clogging occurs, the opening is gradually enlarged, making it possible to eliminate the clogging.

DESCRIPTION OF NUMERALS

Figure 1:
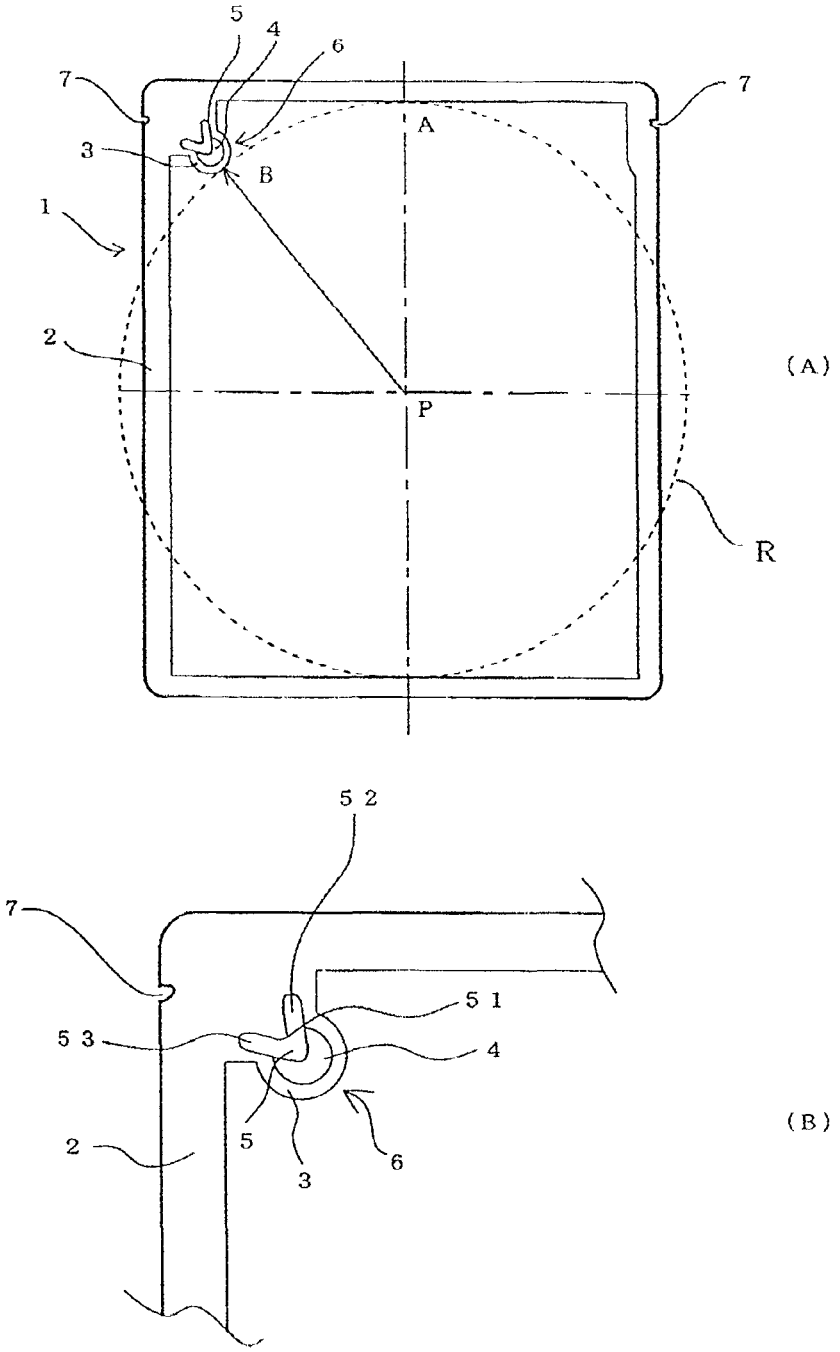
FIG. 1 is a view showing an example of a packaging pouch for a microwave oven according to the present invention.

1 packaging pouch
2 peripheral edge seal portion
3 outer seal portion
4 non-sealed portion
5 weakened portion
6 steam releasing seal portion
7 notch
8 bottom fold-up seal portion
9 perforation
10 through-hole or semi through-hole
51 protrusion
52, 53, 54 chamber
55 constricted portion

BEST MODES FOR CARRYING OUT THE INVENTION

Plastic films forming a packaging pouch for a microwave oven in the present invention employs a plastic laminated film having heat sealing property and generally used for production of a packaging pouch. An example of such plastic material include a multilayer film obtained by laminating a thermoplastic resin having heat sealing property and another thermoplastic resin or the like.

Examples of such the thermoplastic resin having heat sealing property, forming the plastic laminated film include: a known olefin resins such as low density polyethylene, a linear low density polyethylene, a medium density polyethylene, a high density polyethylene, a polypropylene, a propylene-ethylene copolymer, an ethylene-vinyl acetate copolymer, an olefin-based resin subjected to graft modification with an ethylene-based unsaturated carboxylic acid or an anhydride thereof; a polyamide resin or copolyamide resin having a relatively low melting point or relatively low softening point; a polyester resin or copolyester resin; and a polycarbonate resin.

Examples of another plastic material to be laminated with the thermoplastic resin having heat sealing property include a thermoplastic resin having heat sealing property or having no heat sealing property.

Examples of such thermoplastic resin can include: polyolefins such as crystalline polypropylene, a crystalline propylene-ethylene copolymer, crystalline polybutene-1, crystalline poly4-methylpentene-1, low-density polyethylene, medium-density polyethylene, high-density polyethylene, an ethylene-vinyl acetate copolymer (EVA), a saponified product of an EVA copolymer, an ethylene-ethyl acrylate copolymer (EEA), and an ion-crosslinked olefin copolymer (ionomer); aromatic vinyl copolymers such as polystyrene and a styrene-butadiene copolymer; vinyl halide polymers such as polyvinyl chloride and a vinylidene chloride resin; a polyacrylic resin; nitrile polymers such as an acrylonitrile-styrene copolymer and an acrylonitrile-styrene-butadiene copolymer; polyesters such as polyethylene terephthalate and polytetramethylene terephthalate; various polycarbonates; a fluorine-based resin; and polyacetals such as polyoxymethylene. Those thermoplastic resins can be used independently, or with being blended with two or more kinds of them. Furthermore, those thermoplastic resins may be used to be blended with various additives.

The plastic laminated film used in the present invention can be obtained by laminating through a usual method non-oriented or uniaxially or biaxially oriented films with or without the heat sealing property as mentioned above.

In the present invention, a packaging pouch for a microwave oven is formed by heat-sealing such a plastic laminated film by a usual method. When the film is a laminated film formed of a thermoplastic resin with heat sealing property and a thermoplastic resin without heat sealing property, the heat sealing is effected such that the thermoplastic resin layers with heat sealing property constitute the inner surfaces.

In the following, a construction of a packaging pouch for a microwave oven according to the present invention will be described with reference to the drawings.

Figure 2:
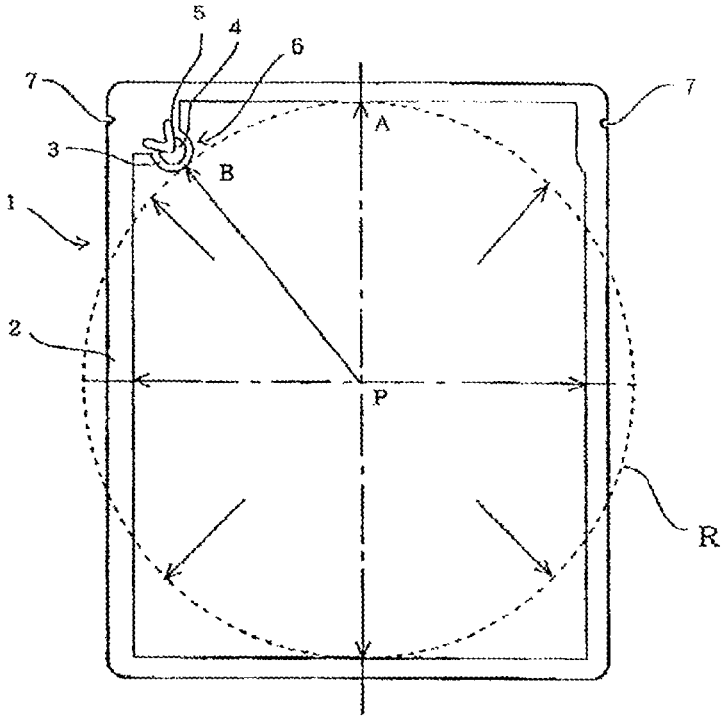
FIG. 2 is a diagram illustrating how stress concentration occurs when the packaging pouch of FIG. 1 is heated.
Figure 3:
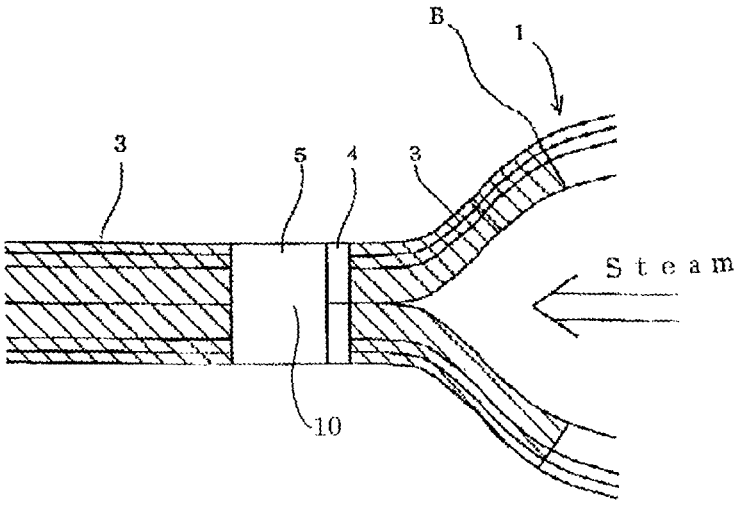
FIG. 3 is a schematic sectional view illustrating how a steam releasing seal portion of the packaging pouch of FIG. 1 is broken open.

FIGS. 1 through 3 are drawings showing an example in which the packaging pouch for a microwave oven of the present invention is applied to a flat pouch. FIG. 1(A) is a plan view of the packaging pouch, and FIG. 1(B) is a schematic partial enlarged view of the steam releasing seal portion of FIG. 1(A). FIG. 2 is a plan view illustrating how stress concentration due to an increase in internal pressure occurs when the packaging pouch of FIG. 1 is heated in an microwave oven. FIG. 3 is a schematic sectional view of the steam releasing seal portion of FIG. 2. In these figures, a packaging pouch is denoted by reference numeral 1, and a peripheral edge seal portion is denoted by reference numeral 2.

In a corner portion of the packaging pouch 1, there is provided a steam releasing seal portion 6 composed of an outer seal portion 3, a non-sealed portion 4 adjacent to the outer seal portion 3, and a weakened portion 5 formed of a substantially heart-shaped through-hole 10 provided in the non-sealed portion 4, with the steam releasing seal portion 6 being connected with the peripheral edge seal portion 2. Further, in the vicinity of the upper end of the peripheral edge portion 2, there are provided notches 7 for opening the packaging pouch 1 after completion of the heating thereof in a microwave oven.

The weakened portion 5 is formed so as to be gradually increased in width from a forward end portion thereof at which the pouch is to be opened toward a rear end portion thereof. Through provision of a protrusion 51 extending from the rear end toward the inner side of the weakened portion 5, the rear end portion of the weakened portion 5 is divided into two chambers 52 and 53.

As shown in FIG. 1, the steam releasing seal portion 6 of the packaging pouch 1 is provided such that an initial breakage point B of the steam releasing seal portion 6 is situated in the circumference of a circle R, which is inscribed in two shorter sides of the peripheral edge seal portion of the packaging pouch at centers A of the two shorter sides thereof, with the inscribed circle R having a radius PA as measured from a center P of the circle (hereinafter simply referred to as "center P").

In the following description of the present invention, the initial breakage point B of the steam releasing seal portion 6 means a point at which opening of the outer seal portion 3 begins in the steam releasing seal portion 6 when the packaging pouch is heated in a microwave oven.

When the packaging pouch 1 is heated, the packaging pouch 1 swells from the center P toward the peripheral edge seal portion 2 due to the steam or the like generated from the content, and, as shown in FIG. 2, stress concentration is generated over a range in conformity with the circle R, having the radius PA, which is the distance from the center P to the inner ends of the shorter sides of the peripheral edge seal portion. As a result of this stress concentration, breakage opening of the outer seal portion 3 begins from the portion B of the steam releasing seal portion 6 nearest to the center P, in other words, the initial breakage point B is the point in the steam releasing seal portion 6 nearest to the center P. By providing the initial breakage point B of the steam releasing seal portion 6 on a circumference or on an inner side of the circle R which is inscribed in the two shorter sides of the peripheral edge seal portion of the packaging pouch at the centers of the two shorter sides, it is possible to more reliably effect the automatic opening at the time of heating.

As shown in FIG. 3, when the packaging pouch is heated, breakage of the steam releasing seal portion 6 begins at the initial breakage point B, and the outer seal portion 3 is separated and recedes due to the stress concentration as a result of the increase in the inner pressure of the pouch. When the separation of the outer seal portion 3 extends via the non-sealed portion 4 to reach the forward end portion of the weakened portion 5, the packaging pouch is partially opened, and the steam or the like is discharged to the exterior, so that it is possible to prevent rupture of the pouch.

Figure 15:
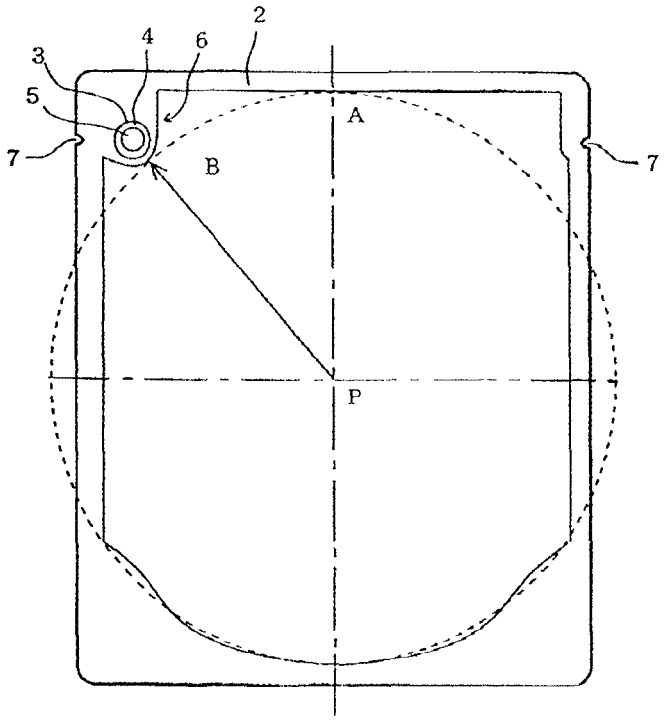
FIG. 15 is a view showing an example of a conventional packaging pouch for a microwave oven.

In a conventional packaging pouch for a microwave oven shown in FIG. 15, the steam releasing seal portion 6 with the weakened portion 5 is formed by simply providing a circular through-hole in the non-sealed portion 4 in the outer seal portion 3. In this packaging pouch, when the steam releasing seal portion 6 is opened as a result of the increase in the inner pressure of the packaging pouch at the time of heating in a microwave oven, a small solid object, such as a rice grain, may be carried to the open steam releasing seal portion 6 by the force with which the steam is discharged, and there is a fear of clogging being generated.

In the packaging pouch 1 of the present invention, the width of the weakened portion 5 is gradually increased from the forward end portion to be opened toward the rear end portion thereof, whereby even if a solid object, such as a rice grain, gets stuck in the open steam releasing seal portion 6, the outer seal portion 3 of the steam releasing seal portion 6 is further separated due to the further increase in the inner pressure of the packaging pouch 1, and it is possible to enlarge the area of the opening, thereby making it possible to automatically eliminate the clogging of the opening. Further, by dividing the rear portion of the weakened portion 5 into the two chambers 52 and 53, any solid object having caused clogging is forced into one of these chambers, thereby making it still easier to eliminate the clogging.

Figure 4:
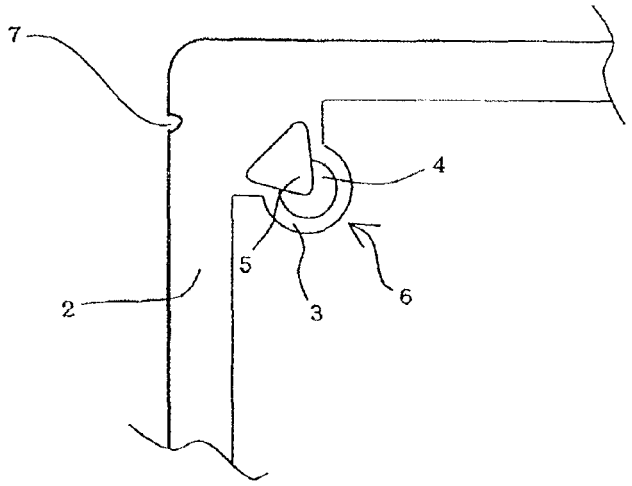
FIG. 4 is a partial enlarged view of another example of a packaging pouch for a microwave oven according to the present invention.

FIG. 4 is a schematic partial enlarged view showing another example of the steam releasing seal portion of the packaging pouch for a microwave oven of the present invention.

In this steam releasing seal portion 6, no protrusion is provided in the rear end portion of the weakened portion 5, and the weakened portion 5 is formed in a substantially triangular configuration. Otherwise, the packaging pouch is of the same construction as the packaging pouch 1 of FIGS. 1 through 3.

Figure 5:
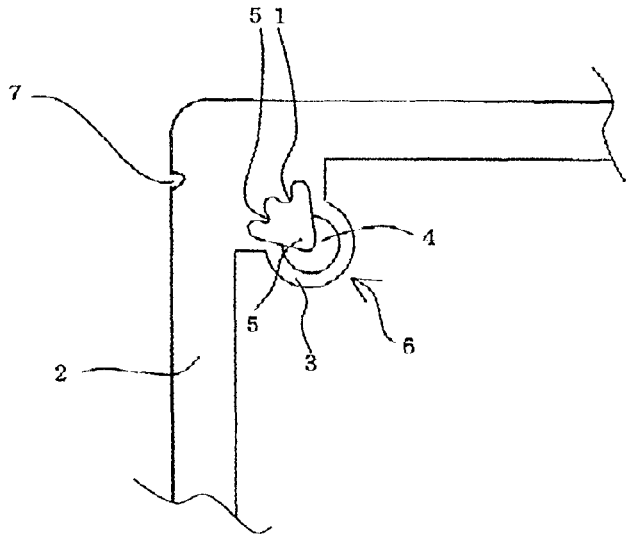
FIG. 5 is a partial enlarged view of further another example of a packaging pouch for a microwave oven according to the present invention.

FIG. 5 is a schematic partial enlarged view showing further another example of the steam releasing seal portion of the packaging pouch for a microwave oven of the present invention.

In this steam releasing seal portion 6, two protrusions 51 directed toward the inner side of the weakened portion 5 are provided in the rear end portion of the weakened portion 5. Otherwise, the packaging pouch is of the same construction as the packaging pouch 1 of FIGS. 1 through 3.

Figure 6:
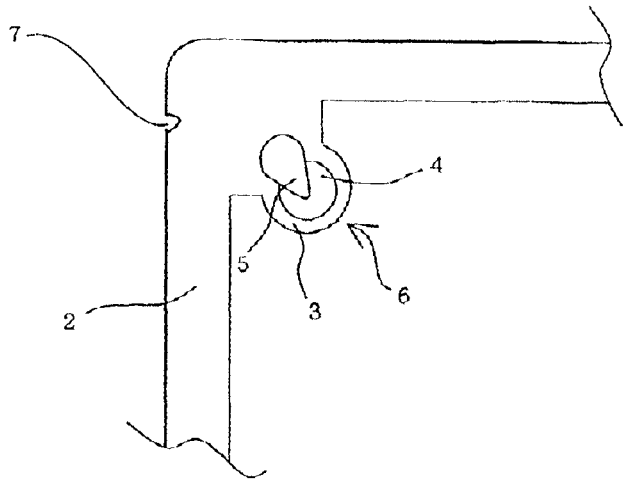
FIG. 6 is a partial enlarged view of still another example of a packaging pouch for a microwave oven according to the present invention.

FIG. 6 is a schematic partial enlarged view showing still another example of the steam releasing seal portion of the packaging pouch for a microwave oven of the present invention.

In this steam releasing seal portion 6, the weakened portion 5 is formed in a substantially water-drop-shaped configuration which diverges toward the rear end portion thereof. Otherwise, the packaging pouch is of the same construction as the packaging pouch 1 of FIGS. 1 through 3.

Figure 7:
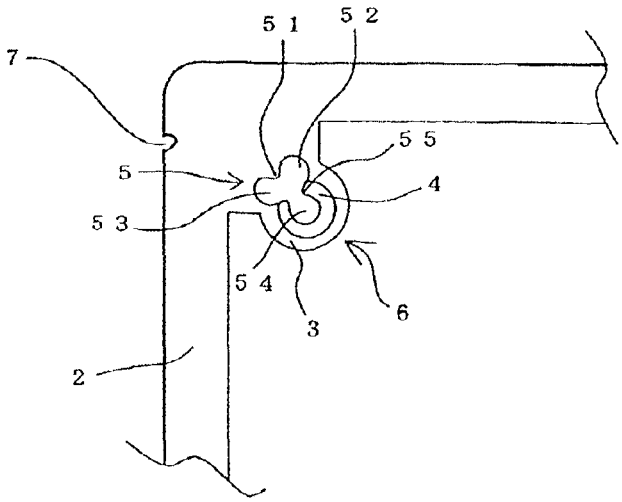
FIG. 7 is a partial enlarged view of yet another example of a packaging pouch for a microwave oven according to the present invention.

FIG. 7 is a schematic partial enlarged view showing yet another example of the steam releasing seal portion of the packaging pouch for a microwave oven of the present invention.

In this steam releasing seal portion 6, the weakened portion 5 is formed by connecting together three substantially circular chambers 52, 53, 54, and a protrusion 51 directed toward the inner side of the weakened portion 5 is provided in the rear end portion, with a constricted portion 55 being provided in a middle portion of the weakened portion 5. Otherwise, the packaging pouch is of the same construction as the packaging pouch 1 of FIGS. 1 through 3.

Figure 8:
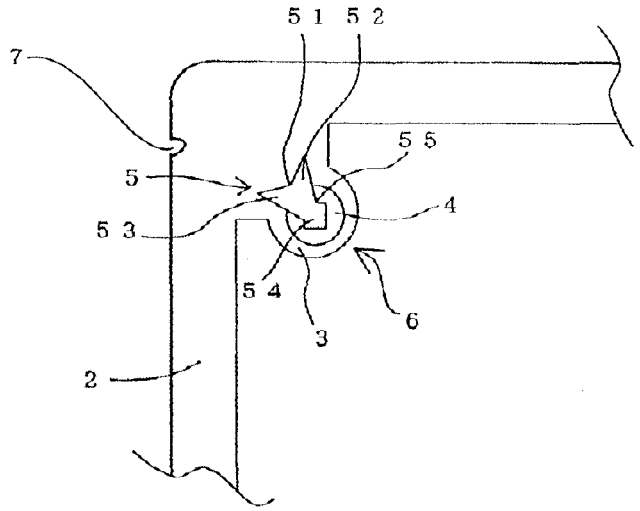
FIG. 8 is a partial enlarged view of further another example of a packaging pouch for a microwave oven according to the present invention.

FIG. 8 is a schematic partial enlarged view showing further another example of the steam releasing seal portion of the packaging pouch for a microwave oven of the present invention.

In this steam releasing seal portion 6, the weakened portion 5 is formed in a substantially arrow-shaped configuration composed of three chambers 52, 53, 54 being connected together, and a protrusion 51 directed toward the inner side of the weakened portion 5 is provided in the rear end portion, with a constricted portion 55 being provided in the middle portion of the weakened portion 5. Otherwise, the packaging pouch is of the same construction as the packaging pouch 1 of FIGS. 1 through 3.

Figure 9:
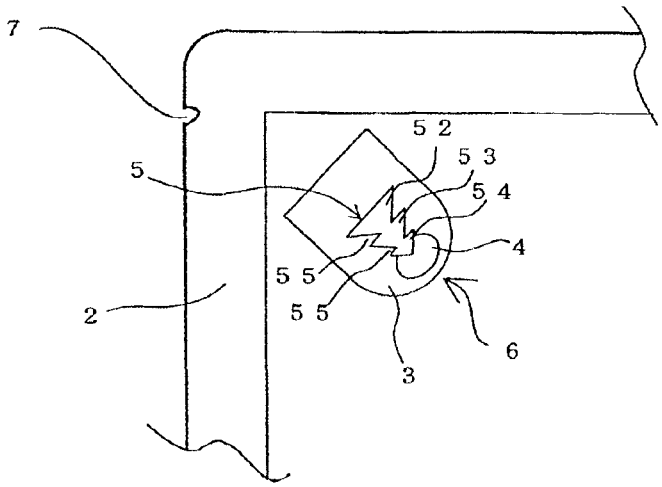
FIG. 9 is a partial enlarged view of still another example of a packaging pouch for a microwave oven according to the present invention.
Figure 10:
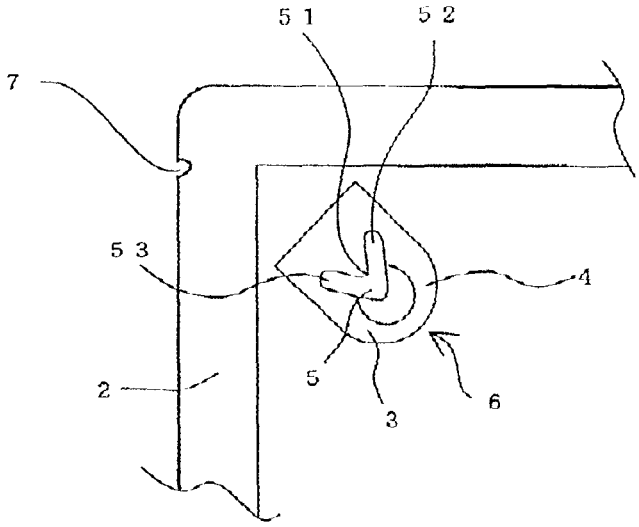
FIG. 10 is a partial enlarged view of yet another example of a packaging pouch for a microwave oven according to the present invention.
Figure 11:
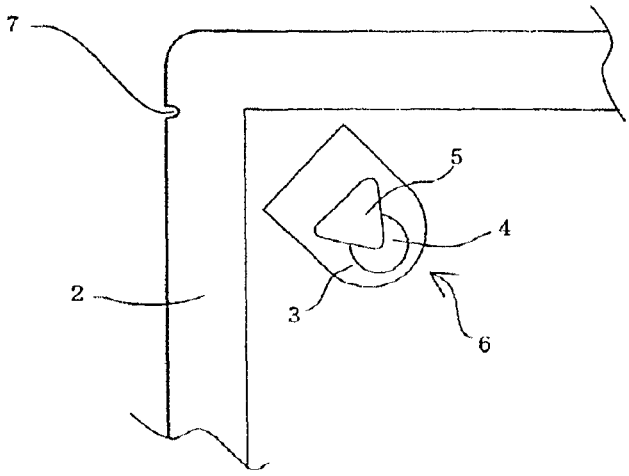
FIG. 11 is a partial enlarged view of further another example of a packaging pouch for a microwave oven according to the present invention.
Figure 12:
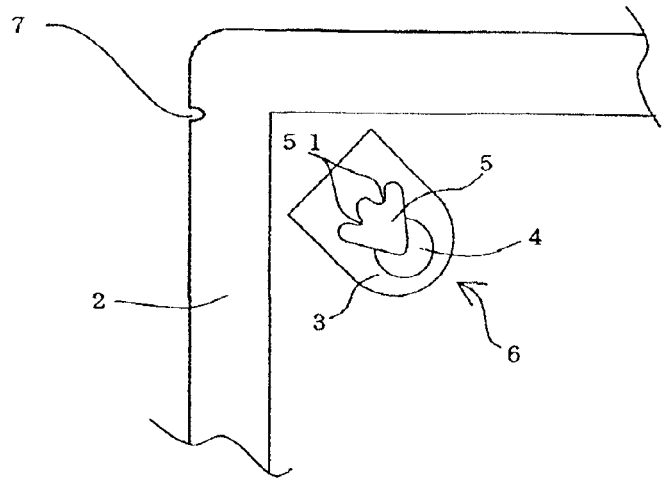
FIG. 12 is a partial enlarged view of still another example of a packaging pouch for a microwave oven according to the present invention.
Figure 13:
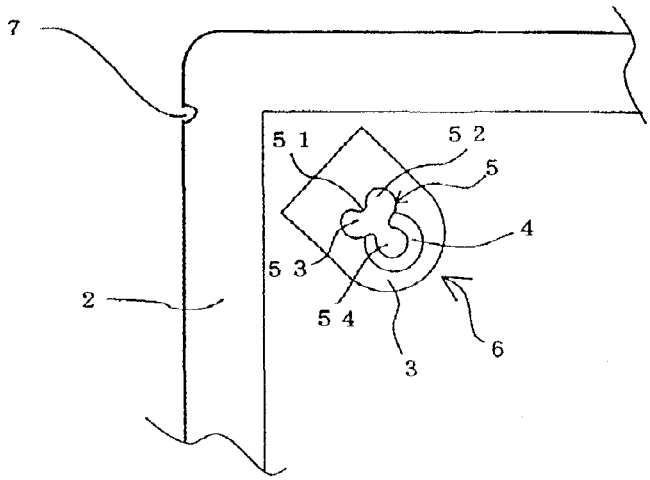
FIG. 13 is a partial enlarged view of yet another example of a packaging pouch for a microwave oven according to the present invention.

FIG. 9 is a schematic partial enlarged view showing still another example of the steam releasing seal portion of the packaging pouch for a microwave oven of the present invention.

In this packaging pouch, the steam releasing seal portion 6 provided in a corner portion is spaced apart from the peripheral edge seal portion 2. In the steam releasing seal portion 6 of this pouch, the weakened portion 5 is formed in a substantially lightning-shaped configuration composed of three regions 52, 53, 54 through provision of constricted portions 55, 55 in the middle portion of the weakened portion 5. Otherwise, the packaging pouch is of the same construction as the packaging pouch 1 of FIGS. 1 through 3.

In the packaging pouches of FIGS. 7 through 9, due to the provision of the constricted portion(s) 55 in the middle portion of the weakened portion, the impact at the time of opening is absorbed, whereby it is possible, for example, to prevent generation of a loud sound that might cause the user uneasiness, to prevent breakage of the film starting from the opening, and to prevent the content from bursting out. When clogging occurs in the steam releasing seal portion, the opening is gradually enlarged to thereby eliminate the clogging. In particular, as shown in FIG. 9, by providing a plurality of constricted portions 55, it is possible to repeat the action thereof, which proves further effective in preventing clogging in the steam releasing seal portion.

FIGS. 10 through 13 are schematic partial enlarged views showing other examples of the steam releasing seal portion of the packaging pouch for a microwave oven of the present invention.

In these packaging pouches, the steam releasing seal portion 6 provided in a corner portion is spaced apart from the peripheral edge seal portion 2. Otherwise, the packaging pouches are of the same construction as the packaging pouch 1 of FIGS. 1 through 3. It goes without saying that, in these packaging pouches, the configuration of the weakened portion 5 formed in the steam releasing seal portion 6 may be modified as appropriate.

Figure 14:
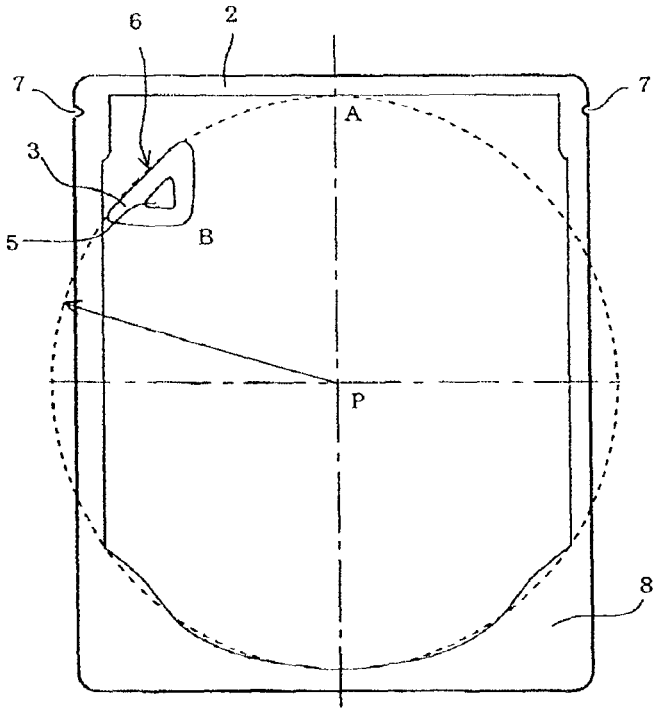
FIG. 14 is a view of further another example of a packaging pouch for a microwave oven according to the present invention.

FIG. 14 is a view showing an example in which the packaging pouch for a microwave oven of the present invention is applied to a standing pouch.

In the packaging pouch 1, the steam releasing seal portion 6 provided in a corner portion is formed in a substantially triangular configuration with rounded corners, and is spaced apart from the peripheral edge seal portion 2, with the initial breakage point B being situated on the inner side of the circle R, which is inscribed in the two shorter sides of the peripheral edge seal portions at the centers thereof. No non-sealed portion is provided in the steam releasing seal portion 6, and a weakened portion 5 composed of a substantially triangular through-hole is provided in the outer seal portion 3, with a bottom fold-up seal portion 8 being provided at the bottom of the packaging pouch. Otherwise, the packaging pouch is of the same construction as the packaging pouch 1 of FIGS. 1 through 3.

In this packaging pouch, the configurations of the steam releasing seal portion 6 and the weakened portion 5, the presence/absence of the non-sealed portion, etc. allow arbitrary selection. It goes without saying that, instead of the steam releasing seal portion 6 of this example, it is also possible to use, as appropriate, the steam releasing seal portions as shown in FIGS. 9 through 13, the steam releasing seal portions as shown in FIGS. 6 and 8, which are spaced apart from the peripheral edge seal portion 2, etc.

In the packaging pouch for a microwave oven of the present invention, the formation of the steam releasing seal portion 6 may be effected simultaneously with the formation of the peripheral edge seal portion 2 of the packaging pouch, or separately therefrom. Apart from heat sealing, the steam releasing seal portion 6 may be formed by impulse sealing, ultrasonic sealing, adhesion by an adhesive, etc. The weakened portion 5 of the steam releasing seal portion 6 may be formed by providing a semi-through-hole instead of a through-hole. Apart from this, various further modifications are naturally possible. For example, it is possible to effect a processing for facilitating opening through perforation, laser processing, etc. at the position where the notches 7, 7 are connected to each other and where the pouch is to be opened.

While in the above specific examples the present invention is applied to a flat pouch and a standing pouch, it goes without saying that the present invention is also applicable to a branch type pouch in which a branch portion is formed in the pouch main body and in which the steam releasing seal portion is provided in the branch portion, and, further, to other types of packaging pouch, such as a three-way seal type, a pillow type, and a gusset type packaging pouch. In particular, when the present invention is applied to a standing pouch, it is possible to heat the pouch in an upright state in a microwave oven, which is advantageous in that the content can be extracted without being spilled out through opening of the pouch after the heating.

The packaging pouch of the present invention is suitable for use as a food packaging pouch which is to be filled with various retort foods, such as rice porridge, curry, stew, meat balls, soup, and sweet red-bean broth, or chilled foods and frozen foods, such as dumplings, shui mai, and pilaf, and which is to be heated in a microwave oven or in hot water.

As a method of producing package bodies in which packaging pouches for a microwave according to the present invention are filled with various foods, it is possible to adopt a so-called in-line sealing system, in which the production of the packaging pouches and the filling thereof with the content are effected successively. In this system, the heat sealing of the peripheral edge seal portion and that of the steam releasing seal portion are usually conducted simultaneously, whereas the cushioning portion and the weakened portion provided in the steam releasing seal portion can be formed by punching, etc. after the heat sealing. Further, it is also possible to previously form the cushioning portion and the weakened portion to be provided in the steam releasing seal portion in the raw film for forming the packaging pouch, producing the pouches through heat sealing of this raw film.

As another method of producing packaged bodies in which packaging pouches are filled with contents, it is also possible to adopt a so-called off-line system in which the packaging pouches are produced beforehand, and in which the packaging pouches are filled with the contents by using a filling machine or some other machine separate from a pouch producing machine before sealing the filling ports. The heat sealing of the steam releasing seal portion can be effected simultaneously with the sealing of the filling ports after the filling of the pouches with the contents, or prior to the filling of the pouches with the contents.

According to the present invention, it is possible to provide at low cost a packaging pouch for a microwave oven in which it is possible to prevent clogging in the steam releasing seal portion at the time of heat-cooking in a microwave oven and in which any clogging occurred can be automatically eliminated.

The invention claimed is:

1. A packaging pouch for a microwave oven hermetically sealed by heat-sealing with a plastic film, comprising:

a peripheral edge seal portion and at least one steam releasing seal portion;

wherein the steam releasing seal portion comprises an outer seal portion, a non-sealed portion adjacent to the outer seal portion, and a through-hole or semi through-hole that projects into the non-sealed portion;

wherein a proximal edge of the through-hole or semi through-hole is disposed within the non-sealed portion and a distal edge of the through-hole or semi through-hole is disposed outside of the non-sealed portion;

wherein the edges of the through-hole or semi through-hole define a hole region where a width of the hole region gradually increases from the proximal edge of the through-hole or semi through-hole toward the distal edge of the through-hole or semi through-hole; and wherein the hole region is further defined by at least one protrusion of the peripheral edge seal portion that extends into the distal edge toward the proximal edge to thereby divide the hole region into plural chambers.

2. The packaging pouch for a microwave oven of claim 1, which further comprises a constricted portion where the hole region is reduced in width in at least one position in a range from the proximal edge toward the distal edge.

3. The packaging pouch for a microwave oven of claim 1, wherein the steam releasing seal portion is provided separately from the peripheral edge seal portion of the packaging pouch.

4. The packaging pouch for a microwave oven of claim 1, wherein the steam releasing seal portion is provided continuously along the peripheral edge seal portion of the packaging pouch.

5. The packaging pouch for a microwave oven of claim 1, which further comprises an initial breakage point of the steam releasing seal portion on a circumference or on an inner side of a circle inscribed in two shorter sides of the peripheral edge seal portion of the packaging pouch at centers of inner ends of the peripheral edge seal portion.

6. The packaging pouch for a microwave oven of claim 1, which further comprises an outlet forming means in the vicinity of the steam releasing seal portion.

7. The packaging pouch for a microwave oven of claim 1, wherein the packaging pouch is one selected from the group consisting of a standing pouch, a flat pouch, and a branch type pouch.

8. The packaging pouch for a microwave oven of claim 1, wherein the peripheral edge seal portion and an outer seal portion of the steam releasing seal portion has a seal strength of 2.3 kg/15 mm or more.

* * * * *